US008571242B2

(12) United States Patent
Bächler et al.

(10) Patent No.: US 8,571,242 B2
(45) Date of Patent: Oct. 29, 2013

(54) METHOD FOR ADAPTING SOUND IN A HEARING AID DEVICE BY FREQUENCY MODIFICATION AND SUCH A DEVICE

(75) Inventors: Herbert Bächler, Meilen (CH); Raoul Glatt, Zürich (CH)

(73) Assignee: Phonak AG, Stafa (CH)

( * ) Notice: Subject to any disclaimer, the term of this patent is extended or adjusted under 35 U.S.C. 154(b) by 238 days.

(21) Appl. No.: 12/994,505

(22) PCT Filed: May 30, 2008

(86) PCT No.: PCT/EP2008/056708

§ 371 (c)(1),
(2), (4) Date: Nov. 24, 2010

(87) PCT Pub. No.: WO2009/143898

PCT Pub. Date: Dec. 3, 2009

(65) Prior Publication Data

US 2011/0150256 A1 Jun. 23, 2011

(51) Int. Cl.
*H04R 25/00* (2006.01)

(52) U.S. Cl.
USPC ..... 381/316; 381/317; 381/320; 381/321; 381/60; 363/16

(58) Field of Classification Search
USPC ..... 381/316, 317, 320, 321, 60, 98, 94.2, 381/94.3, 106, 312, 314, 313, 68
See application file for complete search history.

(56) References Cited

U.S. PATENT DOCUMENTS

| | | | | |
|---|---|---|---|---|
| 5,014,319 | A | 5/1991 | Leibman | |
| 5,394,475 | A | 2/1995 | Ribic | |
| 6,577,739 | B1 | 6/2003 | Hurtig et al. | |
| 6,606,391 | B2 * | 8/2003 | Brennan et al. | 381/316 |
| 7,248,711 | B2 * | 7/2007 | Allegro et al. | 381/316 |
| 2007/0253585 | A1 | 11/2007 | Steinbuss | |

FOREIGN PATENT DOCUMENTS

| | | | |
|---|---|---|---|
| AU | 2002300314 | A1 | 2/2004 |
| DE | 10 2006 019 728 | A1 | 11/2007 |
| EP | 1858292 | A1 | 11/2007 |
| WO | 2007/000161 | A1 | 1/2007 |
| WO | 2007/110073 | A1 | 10/2007 |

OTHER PUBLICATIONS

International Search Report for PCT/EP2008/056708 dated Apr. 28, 2009.
Written Opinion for PCT/EP2008/056708 dated Apr. 28, 2009.

* cited by examiner

*Primary Examiner* — Tammy Pham
*Assistant Examiner* — Frantz Bataille
(74) *Attorney, Agent, or Firm* — Pearne & Gordon LLP

(57) ABSTRACT

In a digital hearing aid device (1) frequency modification is employed above a lower spectral bound and in accordance with a compression factor. The frequency modification is dynamically adjusted in dependence on a sound environment analysis (10) or an end-user input (30), by modifying the frequency modification parameters such as a lower spectral bound and a compression factor. The adjustment can be based on an interpolation between predefined parameters. In certain sound environments, such as loud noise, own-voice and telephone conversations, frequency modification is reduced or switched off. The proposed solutions have the advantage that the occurrence of disturbing noise and of distortions of harmonic relationships at the end-user's ear is reduced and signal processing resources as well as battery resources are saved.

35 Claims, 8 Drawing Sheets

METHOD FOR ADAPTING SOUND IN A HEARING AID DEVICE BY FREQUENCY MODIFICATION AND SUCH A DEVICE

TECHNICAL FIELD

The invention relates to the field of adapting sound in a hearing aid device to the needs of an end-user of such a device by frequency modification. More particularly, it relates to a method for adapting sound according to the preamble of claim 1 and to a hearing aid device for carrying out such a method according to the preamble of claim 21.

BACKGROUND OF THE INVENTION

The most basic way to adapt sound to the needs of hearing impaired individuals is to simply amplify the sound. However, many times amplification is not sufficient, for example, if the hearing loss for a particular frequency is to large such that the maximum output level of the device is reached before the sound can be perceived by the individual. Sometimes there are so called "dead regions", which means that sounds of specific frequencies cannot be perceived at all no matter how much they are amplified. In view of this, devices have been developed which do not simply amplify, but also change the frequency of spectral components such that they can be perceived in frequency regions where the hearing of the individual is better.

U.S. Pat. No. 5,014,319 discloses a frequency transposing hearing aid. The hearing aid apparatus comprises a pair of analogue delay lines. A transposition factor is a ratio of information storage rate to information retrieval rate. There are means for inputting at least two different transposition coefficients predetermined according to the user's hearing characteristics for different frequencies. There are frequency analyzer means to select the appropriate transposition coefficient according to the frequency of the incoming signal.

U.S. Pat. No. 5,394,475 discloses a device for transposing the frequency of an input signal. It may be provided that a momentary frequency signal is subjected to a controlling means. In this way it is possible to change the extent of frequency shift. The control can be made manually through a potentiometer by the carrier of the hearing aid or depending on the volume encountered. A non-linear transformer can be provided to shift individual frequency ranges to different extents. The document mentions digital technology and Fourier transformation.

U.S. Pat. No. 6,577,739 discloses an apparatus for proportional audio compression and frequency shifting. The fast Fourier transform of the input signal is generated, to allow processing in the frequency domain. By proportionally shifting the spectral components the lawful relationship between spectral peaks associated with speech signals is maintained so the listener can understand the information.

AU 2002/300314 discloses a method for frequency transposition in hearing aids. Preferably, a fast Fourier transform is used. In an example input frequencies up to 1000 Hz are conveyed to the output of the hearing-aid without any shifting. Frequencies above 1000 Hz are shifted downwards progressively such that an input frequency of 4000 Hz is conveyed to the output after being transposed downwards by one octave, to produce an output frequency of 2000 Hz.

U.S. Pat. No. 7,248,711 discloses a method for frequency transposition in a hearing device. There is a nonlinear frequency transposition function. Thereby, it is possible to transpose lower frequencies almost linearly, while higher frequencies are transposed more strongly. As a result thereof, harmonic relationships are not distorted in the lower frequency range. In an embodiment the frequency transposition function has a perception based scale. In regard to frequency compression fitting it is mentioned that there are the parameters compression ratio above the cut-off frequency and cut-off frequency.

WO 2007/000161 discloses a hearing aid for reproducing frequencies above the upper frequency limit of a hearing impaired user. There are means for transposing higher bands down in frequency. There are means for superimposing the transposed signal onto an other signal creating a sum signal. The transposition down in frequency can be by a fixed amount, e.g. an octave.

DE 10 2006 019 728 discloses a time-adaptive hearing aid device. A part of the input spectrum is shifted automatically from a first frequency to a second frequency as a function of time. Thereby a time-adaptive parameterisation of the compression ratio is achieved. The spontaneous acceptance of a hearing system is improved and there is support for the acclimatization of the hearing impaired to new frequency patterns.

Generally it can be concluded that there are numerous frequency modification schemes known in the state of the art. However, each of them is somehow imperfect in regard to one or more of the following aspects:

- Finding an optimum trade-off between the presence of artefacts, disturbing noises or disharmonies and an improved intelligibility of speech;
- Allowing a reasonable technical implementation, which includes issues such as circuit complexity, power consumption and processor load;
- Avoiding information loss which may be caused by superposition of signals or incomplete playback when signals are played back at a reduced speed;
- Opening up the possibility to provide solutions for individuals with mild or moderate hearing losses.

SUMMARY OF THE INVENTION

In the present document the term "frequency modification" is used. It is meant to cover, unless otherwise indicated, any kind of signal processing which changes the frequency of spectral components of a signal, in particular according to a frequency mapping function as explained further down below.

In the present document further the term "hearing aid device" is used. It denominates a device, which is at least partially worn adjacent to or inserted into an individual's ear and which is designed to improve the environment sound perception of a hearing impaired individual towards the environment sound perception of a "standard" individual. The term is meant to cover any devices which provide this functionality, even if the main purpose of the device is something else, as for example in the case of a telephone head-set which provides as an additional feature the functionality of a hearing aid device.

The actual user of a hearing aid device is termed "end-user" in this document, whereas during configuration of hearing aid devices—or systems comprising hearing aid devices—may be operated by further users, such as audiologists or so called "fitters" whose task is the fitting of hearing aid devices to the hearing loss of a particular end-user.

Frequency modification can be adjusted by adjusting "frequency modification parameters". Frequency modification parameters are parameters which describe or define how a particular frequency modification is to be performed. In the present document the following parameters are regarded to be frequency modification parameters:

a frequency delta, e.g. $f_{shift}$, by which an entire or a partial spectrum is shifted, in particular quantified as number of Hertz, a linear compression factor, e.g. CF, according to which a linear frequency modification is applied to an entire or partial spectrum, in particular quantified as a ratio of an input frequency, e.g. $f_{in}$, and an output frequency, e.g. $f_{out}$, or as a number of octaves or other musical intervals, a logarithmic or perception based compression factor, e.g. LCF or PCF, according to which a logarithmic or perception based frequency modification is applied to an entire or partial spectrum, in particular quantified as a ratio of an input bandwidth and an output bandwidth, wherein both bandwidths are measured on a logarithmic scale and/or are expressed as a number of octaves or other musical intervals, a lower spectral bound, e.g. $f_0$, of a frequency range to which frequency modification is applied, an upper spectral bound, e.g. $f_{max}$, of a frequency range to which frequency modification is applied, a number of frequency ranges to which frequency modification is applied, a mapping parameter being part of a frequency mapping function, e.g. $f_{map}$, which maps input frequencies to output frequencies, an amplification parameter indicative of an amplification of modified frequencies relative to an amplification of unmodified frequencies, an intermediate parameter, from which at least one of frequency delta, linear compression factor, logarithmic or perception based compression factor, lower spectral bound, upper spectral bound, number of frequency ranges, mapping parameter, amplification parameter are derived.

It is to be noted that for a particular frequency modification scheme typically only a subset of these parameters is used for defining it. For example a frequency modification scheme may not apply shifting of several frequencies by the same frequency delta, such that there is no parameter "frequency delta" or $f_{shift}$. A frequency modification scheme can for example be defined by the three parameter subset consisting of said lower spectral bound, said upper spectral bound and said logarithmic compression factor.

All aspects of the invention address the general problem that in some situations frequency modification may produce artefacts and unwanted and in particular disharmonious noises and may use unnecessarily large amounts of battery and processing resources, often without providing reasonable benefit to the end-user.

A first aspect of the invention addresses the problem of providing a method for adjusting frequency modification parameters in dependence on a sound environment analysis and/or in dependence on an end-user control in an efficient, accurate and easily configurable way, wherein the adjustment optimally suites a particular hearing situation and does not cause switching artefacts.

This problem is solved by the features of claim 1, namely by a method for adapting sounds in a hearing aid device to the needs of an end-user of said hearing aid device by frequency modification, said frequency modification being defined by one or more of the above described frequency modification parameters, the method comprising the step of:

adjusting said frequency modification in dependence on a result of a sound environment analysis and/or in dependence on an end-user input by adjusting at least one of said one or more frequency modification parameters.

The method according to said first aspect of the invention is characterized by the steps of:

providing predefined frequency modification parameters for at least a first and a second typical sound environment and/or for at least a first and a second state of an end-user controllable parameter, automatically adjusting at least one of said one or more frequency modification parameters based on said predefined frequency modification parameters whenever said sound environment analysis indicates a change of a currently encountered sound environment and/or whenever a change of said end-user controllable parameter occurs.

A second aspect of the invention addresses the problem of reducing disturbing noise, artefacts and in particular occlusion, at the end-user's ear while maintaining signals which carry useful information.

This problem is solved by the features of claim 7, namely by a method for adapting sounds in a hearing aid device to the needs of an end-user of said hearing aid device by frequency modification, said frequency modification being defined by one or more of the above described frequency modification parameters, the method comprising the step of:

adjusting said frequency modification in dependence on a result of a sound environment analysis by adjusting at least one of said one or more frequency modification parameters, wherein said sound environment analysis provides a first analysis value indicative of whether said end-user's own-voice is present, wherein at least one of said one or more frequency modification parameters is adjusted in dependence on said first analysis value.

A third aspect of the invention addresses the problem of reducing disturbing noise and saving processing and battery resources during input signal situations with limited high frequencies such as telephone conversations.

This problem is solved by the features of claim 8, namely by a method for adapting sounds in a hearing aid device to the needs of an end-user of said hearing aid device by frequency modification, said frequency modification being defined by one or more of the above described frequency modification parameters, the method comprising the step of:

adjusting said frequency modification in dependence on a result of a sound environment analysis by adjusting at least one of said one or more frequency modification parameters, wherein said sound environment analysis provides a second analysis value indicative of whether said end-user is in a listening situation, in which a predominant listening target is a sound source with limited high frequencies, wherein at least one of said one or more frequency modification parameters is adjusted in dependence on said second analysis value.

The term "limited high frequencies" is to be understood relative to the basic frequency range of the hearing aid device. Hence, the highest frequency emitted by such a sound source with limited high frequencies is significantly below the highest frequency which can be processed by the hearing aid device. The term "significantly below" can be defined as having a frequency which is, in regard to its Hertz value, at least 25% smaller.

A fourth aspect of the invention addresses the problem of reducing unwanted noise and artefacts, in particular harmonic distortions, at the end-user's ear in situations where frequency modification is unlikely to improve the intelligibility of speech.

This problem is solved by the features of claim 10, namely by a method for adapting sounds in a hearing aid device to the needs of an end-user of said hearing aid device by frequency modification, said frequency modification being defined by one or more of the above described frequency modification parameters, the method comprising the step of:

adjusting said frequency modification in dependence on a result of a sound environment analysis by adjusting at least one of said one or more frequency modification parameters, wherein said sound environment analysis provides a third analysis value indicative of whether a current sound environment is sufficiently noisy to mask normally loud spoken speech or to mask certain normally loud spoken phonemes, wherein at least one of said one or more frequency modification parameters is adjusted in dependence on said third analysis value.

A fifth aspect of the invention addresses the problem that in certain conditions frequency modification might have no benefit for the end-user or even deteriorate the usefulness of the signal while consuming energy and processing resources.

This problem is solved by the features of claim 13, namely by a method for adapting sounds in a hearing aid device to the needs of an end-user of said hearing aid device by frequency modification, said frequency modification being defined by one or more of the above described frequency modification parameters, the method comprising the step of:

adjusting said frequency modification in dependence on a result of a sound environment analysis by adjusting at least one of said one or more frequency modification parameters, wherein said sound environment analysis is configured to provide an indication whether applying a particular frequency modification would result in a condition where a first signal component is shifted into an excitation pattern of a second signal component, wherein, whenever there is said indication, said condition is avoided by adjusting at least one of said one or more frequency modification parameters and/or by attenuating said second signal component.

A sixth aspect of the invention addresses the problem to provide a method for adapting sound by frequency modification which is well suited for end-users with a hearing impairment in the high frequencies, and which provides a good compromise between the intelligibility of speech and the occurrence and intensity of artefacts and disturbing noises, as well as the use of processing and battery resources. It addresses in particular the problem of finding a frequency modification scheme which is well suited to be dynamically adjusted during everyday life in dependence on a result of a sound environment analysis and/or in dependence on an end-user input.

These problems are solved by the features of claim 15, namely by a method for adapting sounds in a hearing aid device to the needs of an end-user of said hearing aid device by frequency modification, said frequency modification being defined by the following three of the above described frequency modification parameters:

said lower spectral bound, said logarithmic or perception based compression factor and said upper spectral bound, wherein frequencies below said lower spectral bound remain substantially unchanged and frequencies between said lower spectral bound and said upper spectral bound are progressively down-shifted without superposition in accordance with said logarithmic or perception based compression factor and wherein above said upper spectral bound substantially no processing takes place, the method comprising the step of:

adjusting said frequency modification in dependence on a result of a sound environment analysis and/or in dependence on an end-user input by adjusting at least one of said three frequency modification parameters.

These problems are also solved by the features of claim 20, namely by a hearing aid device comprising at least one microphone, an analogue to digital converter, a transform means for generating a frequency domain output signal, a sound environment analysis means and/or an end-user input means, a signal processing means configured for performing a frequency modification in which frequencies below a lower spectral bound remain substantially unchanged and frequencies between said lower spectral bound and an upper spectral bound are modified by a progressive down-shifting without superposition in accordance with a logarithmic or perception based compression factor and wherein above said upper spectral bound substantially no processing takes place, an inverse fast Fourier transform means for generating a time domain output signal, a digital to analogue converter and a receiver for presenting an output to the ear of an end-user, wherein said sound environment analysis means and/or said end-user input means are configured for adjusting one or more of the following:

said logarithmic or perception based compression factor, said lower spectral bound, said upper spectral bound.

The solutions of claims 15 and 20 have the advantage that high frequency environment sounds are made better perceivable by the intended end-user without severely compromising the perception of low frequency environment sounds. The solutions have further the advantage that the possibility is opened up to reduce the overall presence of frequency modification. Such a reduction means that there are fewer distortions of harmonic relationships which improves the naturalness and quality of sound, in particular the quality of music, and makes noise less annoying. Further, processing and battery resources are saved.

It is to be noted that the above described aspects of the invention can each be carried out separately, but can also be combined in various ways in a single embodiment.

If the aspects are combined, the terms "at least one of said one or more frequency modification parameters" may refer to different subsets of frequency modification parameters, but may refer also to the same subset of frequency modification parameters.

The advantages of the methods correspond to the advantages of corresponding devices and vice versa.

Further embodiments and advantages emerge from the dependent claims and the description referring to the figures.

BRIEF DESCRIPTION OF THE DRAWINGS

Below, the invention is described in more detail by means of examples and the included drawings.

The reference symbols used in the figures and their meaning are summarized in a list of reference symbols. The described embodiments are meant as examples and shall not confine the invention.

DETAILED DESCRIPTION OF THE INVENTION

Figure 1:
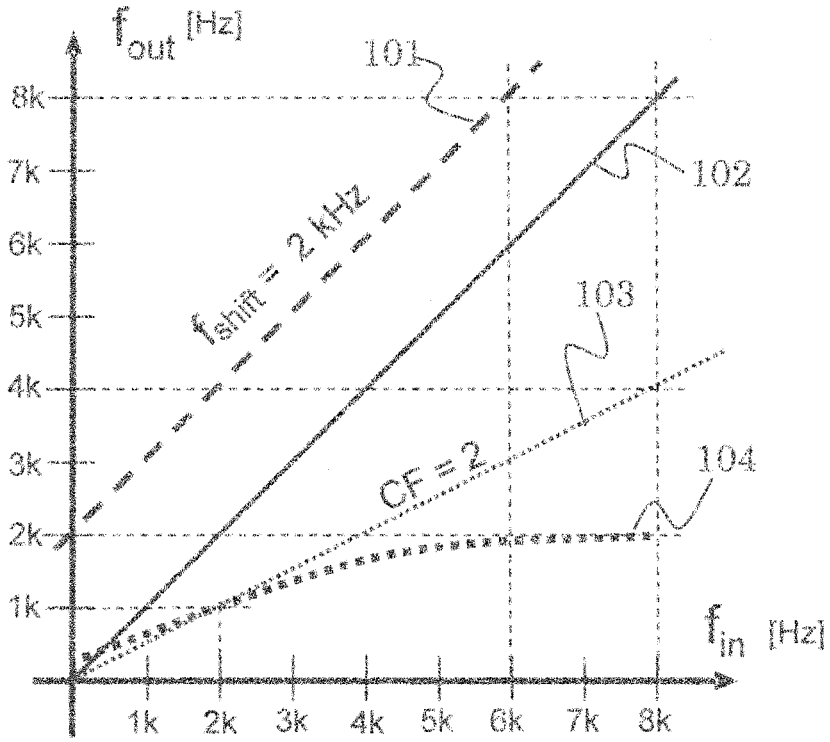
FIG. 1 shows a diagram of the input/output frequency relation in different frequency modification schemes with a linear scaling.
Figure 2:
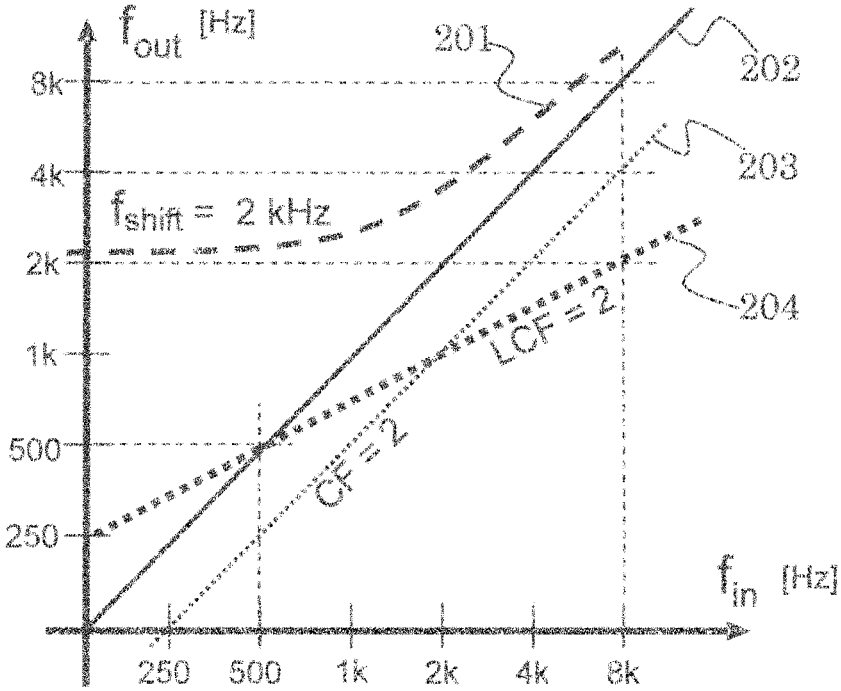
FIG. 2 shows the same diagram as in FIG. 1, but with a logarithmic scaling.

FIGS. 1 and 2 show the frequency mapping of different frequency modification schemes. Frequency modifications schemes can be defined by frequency mapping functions $f_{map}(\ )$ which define to which output frequency particular input frequencies are to be mapped:

$$f_{out}=f_{map}(f_{in})$$

If different input frequencies $f_{in}$ are mapped to the same output frequency, the operation is termed "superposition of signals". Superposing signals has the disadvantage that information may be lost since only the stronger ones may be detectable or perceivable. In particular soft sounds cannot be detected any more because of louder ones at the same frequency. Due to the information loss, the term "destructive superposition" may also be used. Superposition typically occurs when frequencies of a first range are mapped to a second range, while the frequencies of the second range remain unchanged.

When applying a frequency mapping there is further the aspect of harmonicity, firstly the harmonicity within the signal and secondly the harmonicity between input and output signal. For example, when applying a mapping $$f_{out}=\tfrac{1}{2}*f_{in}$$

the signal is transposed by one octave. Hence, the output signal and the input signal are harmonious. Further the harmonic relationships within the input signal are maintained, for example a third remains a third and an octave remains an octave. When applying a mapping $$f_{out}=0.7*f_{in}$$

the harmonious relationships within the signal are preserved while input and output signal are not harmonious. Finally for example a mapping $$f_{out}=0.7*f_{in}-1\text{ kHz}$$

will not preserve the harmonious relationships within the signal nor will there be harmonicity between input and output signal. Even though it seems desirable to maintain both kinds of harmonic relationships such schemes have the disadvantage that the mapping must be applied to the entire spectrum or superposition must be introduced.

In the present document the term "linear frequency modification" is used to denominated frequency modification schemes the frequency mapping function of which is a linear function, as for example $$f_{out}=1/\mathrm{CF}*f_{in}+f_{shift}$$

CF is a linear compression factor. Such a mapping function appears in an input/output graph with linear scaling, such as FIG. 1, as a straight line.

In the present document the term "logarithmic frequency modification" is used to denominated frequency modification schemes the frequency mapping function of which is a logarithmic function, as for example the function defined by the equation $$\log(f_{out})=\frac{1}{LCF}\times\log(f_{in})+\left(1-\frac{1}{LCF}\right)\times\log(f_0)$$

LCF is a logarithmic compression factor. Such a mapping function appears in an input/output graph with logarithmic scaling, such as FIG. 2, as a straight line. Since frequencies are perceived by humans rather in a logarithmic manner than in a linear manner, it is especially advantageous to modify frequencies based on such a logarithmic scheme.

Obviously the compression factors can also be defined reciprocally such that 1/CF is to be substituted by CF and 1/LCF is to be substituted by LCF.

FIGS. 1 and 2 illustrate the same frequency modification schemes with the only difference that FIG. 1 has a linear scale and FIG. 2 has a logarithmic scale. Curves 102 and 202 represent processing without frequency modification. Curves 101 and 201 represent a frequency independent shifting, more precisely, an up-shift by a frequency independent shifting distance or frequency delta $f_{shift}$ of 2 kHz. Curves 103 and 203 represent a downwards-transposition by one octave which is applied to the entire spectrum. Such a modification is a linear frequency modification with a linear compression factor CF=2. For example a band of width 2 kHz is compressed into a band of width 1 kHz, independent of its location on the frequency axis. Curves 104 and 204 show a logarithmic frequency modification. The information of six octaves is compressed to fit into three octaves. Here, the compression factor has a different meaning than in the linear case. It also defines how much smaller a portion of the spectrum is after frequency modification in comparison to before, but now this comparison is made based on a logarithmic frequency scale. In the case illustrated by curves 104 and 204 the logarithmic compression factor LCF is 2. Curves 103 and 203 represent a frequency modification scheme which preserves the harmonic relationships of the input signal components. If the logarithmic compression factor LCF is a whole number, there is also a harmonic relation between input and output signal. Curves 101, 201 and 104, 204 represent frequency modification schemes which distort the harmonic relationships of the input signals components.

Referring to FIGS. 1 and 2 the following frequency modification parameters have been described:

the frequency delta $f_{shift}$ by which frequencies are shifted, in particular quantified as number of Hertz, the linear compression factor CF which can be quantified as a ratio of an input frequency $f_{in}$ and an output frequency $f_{out}$ or as a number of octaves or other musical intervals, the logarithmic compression factor LCF which can be quantified as a ratio of an input bandwidth and an output bandwidth, wherein both bandwidths are measured on a logarithmic scale and/or are expressed as a number of octaves or other musical intervals, However, more generalized any mapping parameter being part of the above mentioned frequency mapping function $f_{map}$ which maps input frequencies to output frequencies, can be regarded as a frequency modification parameter.

In the examples of FIGS. 1 and 2, frequency independent shifting, linear frequency modification and logarithmic frequency modification are each applied to the entire spectrum. However, this frequency modification scheme can also be applied only to part of the spectrum. The remaining spectrum can either be left without frequency modification or it can be subject to a different kind of frequency modification. Further frequency modification parameters result from defining such partial modifications, in particular:

a number or selection of frequency ranges to which frequency modification is applied, a lower spectral bound $f_0$ of a frequency range to which frequency modification is applied and an upper spectral bound $f_{max}$ of a frequency range to which frequency modification is applied.

An example for the last mentioned two parameters is given below in the description referring to FIGS. 3 and 4.

Figure 3:
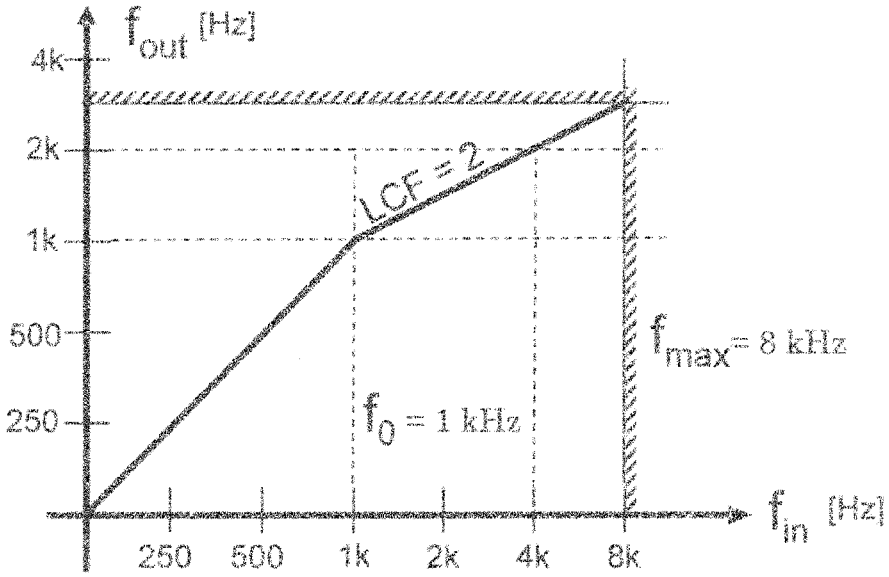
FIG. 3 shows a diagram of the input/output frequency relation in a frequency modifying hearing aid device according to one embodiment of the present invention.
Figure 4:
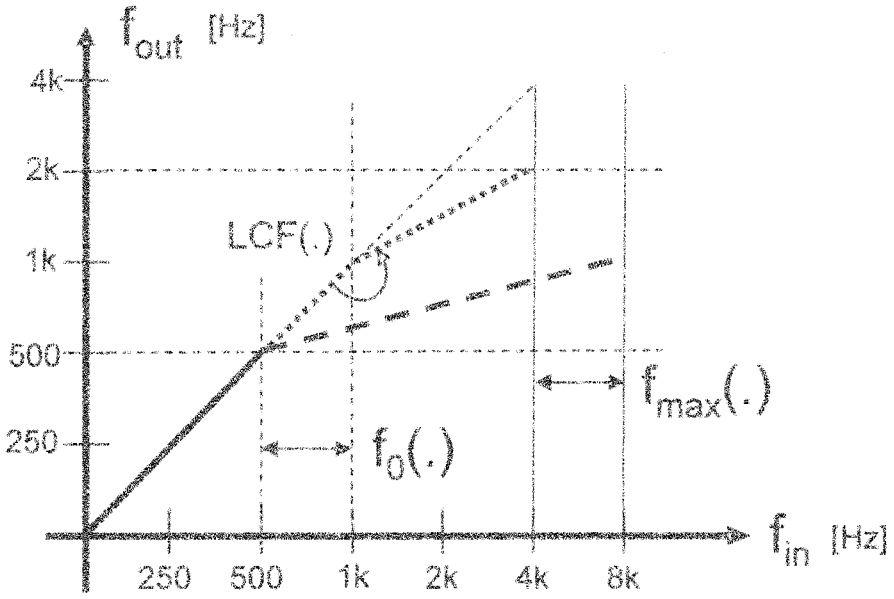
FIG. 4 shows the same diagram as in FIG. 3, but further illustrating the different frequency modification parameters.

FIGS. 3 and 4 are diagrams of the input/output frequency relation in a hearing aid device with a logarithmic frequency modification according to one embodiment of the present invention. The diagrams have a logarithmic frequency scaling. Frequencies remain unchanged up to a lower spectral bound $f_0$, i.e. there is no frequency modification. The lower spectral bound $f_0$ may also be termed "cut-off frequency". Above the lower spectral bound $f_0$, frequencies are modified by progressively down-shifting them without superposition in accordance with a logarithmic compression factor LCF. The term "progressively" indicates that higher frequencies are shifted more than lower ones. The modification is defined by the equation $$\log(f_{out}) = \begin{cases} \log(f_{in}) & \text{for } f_{in} < f_0 \\ \frac{1}{LCF} \times \log(f_{in}) + \left(1 - \frac{1}{LCF}\right) \times \log(f_0) & \text{for } f_{in} \geq f_0 \end{cases}$$

which is equivalent to the equation $$f_{out} = \begin{cases} f_{in} & \text{for } f_{in} < f_0 \\ f_0 \times \left(\frac{f_{in}}{f_0}\right)^{\frac{1}{LCF}} & \text{for } f_{in} \geq f_0 \end{cases}$$

Signal components above an upper spectral bound $f_{max}$ are discarded. The upper spectral bound is therefore in this embodiment equal to the maximum input frequency of the hearing aid device. In the example shown in FIG. 3, the lower spectral bound is 1 kHz, the logarithmic compression factor LCF is 2 and the maximum input frequency is 8 kHz. The frequency range from 1 to 8 kHz (three octaves bandwidth) is mapped by a frequency lowering into the frequency range from 1 to about 2.8 kHz (one and a half octaves). Whenever such a kind of frequency modification is used, harmonic relationships of input sound components can get distorted due to the frequency modification. Such distortions are particularly unpleasant in loud sound environments. Noise with such distortions is perceived more disturbing due to psychoacoustic effects. In particular, music is not as enjoyable if the harmonic relationships are changed. Generally, only input signals with a spectral content not exceeding the lower spectral bound $f_0$ will sound natural.

The present invention opens up the possibility to reduce these disadvantages. The frequency modification and in particular the "extent of frequency modification" is adjusted dynamically during use of the hearing aid device by applying different logarithmic compression factors LCF, by applying different lower spectral bounds $f_0$ and/or by applying different upper spectral bounds $f_{max}$. According to the state of the art, namely AU 2002/300314, these parameters are static, i.e. not adjusted during real life operation by the end-user. According to the present invention at least one of these parameters is adjusted dynamically based on a sound environment analysis and/or based on an end-user input. Examples on how an adjustment based on a sound environment analysis can be implemented are described further down below, in particular referring to FIGS. 5, 7, 8, 11 and 12.

FIG. 4 illustrates how the frequency modification according to the scheme of FIG. 3 can be adjusted. The dashed line is defined by the parameter vector ($f_0$=500 Hz, LCF=4, $f_{max}$=8 kHz). The dotted line is defined by the parameter vector ($f_0$=1 kHz, LCF=2, $f_{max}$=4 kHz) . A parameter vector with LCF=1 or $f_0$=$f_{max}$ represents a state where frequency modification is switched off. It is to be noted that any selection of these three parameters can be subject to dynamic adjustment while the remaining parameters are static, i.e. are defined and programmed in the factory or during a fitting session and are left unchanged afterwards. It is further to be noted that each of these parameter influences the extent of frequency modification, in particular also $f_{max}$, because lowering $f_{max}$ reduces the width of the part of the spectrum, to which frequency modification is applied.

In a particular implementation the upper spectral bound $f_{max}$ is static and the extent of frequency modification is increased by lowering the lower spectral bound $f_0$ and/or by raising the logarithmic compression factor LCF.

Typically, in the case of a static programming, the lower spectral bound $f_0$ will be in the range from 1 kHz to 2 kHz or in the range from 1.5 kHz to 4 kHz, the logarithmic compression factor LCF in the range from 1 to 5 and the upper spectral bound $f_{max}$ in the range from 8 to 10 kHz. In the case of dynamic modification the lower spectral bound $f_0$ may be varied in the range from 1 to 10 kHz, the logarithmic compression factor LCF from 1 to 5 or from 1 to 3, and the maximum input frequency in the range from 3.5 to 10 kHz. For the dynamically adjusted parameters border values may be defined, in particular during a fitting session, for example restricting the logarithmic compression factor to a range from 1 to 2.

Adjusting the frequency modification fully or partially by changing the lower spectral bound $f_0$, and/or possibly also the upper spectral bound $f_{max}$ has the advantage that signal processing resources are saved, whenever frequency modification is reduced.

In an alternative embodiment of the invention, the frequency modification above the lower spectral bound $f_0$ can have an other kind of "perception based frequency modification" instead of a logarithmic frequency modification. Different kinds of perception based frequency modification schemes are disclosed in U.S. Pat. No. 7,248,711. In this case, the compression factor may be called "perception based compression factor" (PCF). In the present document the term "logarithmic or perception based compression factor" (LCF, PCF) is used in order to include both kinds of embodiments, the ones with logarithmic frequency modification and the ones with an other type of perception based frequency modification. The logarithmic or perception based compression factor (LCF, PCF) defines the ratio of an input bandwidth and an output bandwidth, or vice versa, wherein both bandwidths being measured on a logarithmic or perception based scale. Measuring bandwidths on a logarithmic scale is equivalent to expressing bandwidths as a number musical intervals, such as octaves, as already indicated referring to curves 104 and 204 and referring to FIGS. 3 and 4.

In a further alternative embodiment of the invention, instead of no frequency modification below the lower spectral bound $f_0$, there is a linear, harmonics preserving frequency modification in the range below $f_0$. Such a linear frequency modification is also described in more detail in U.S. Pat. No. 7,248,711. The linear compression factor which defines the frequency modification below the lower spectral bound $f_0$ is preferably static, but may be adjusted during a fitting session, when the hearing aid device is adapted to the needs of a particular individual by a professional.

Figure 5:
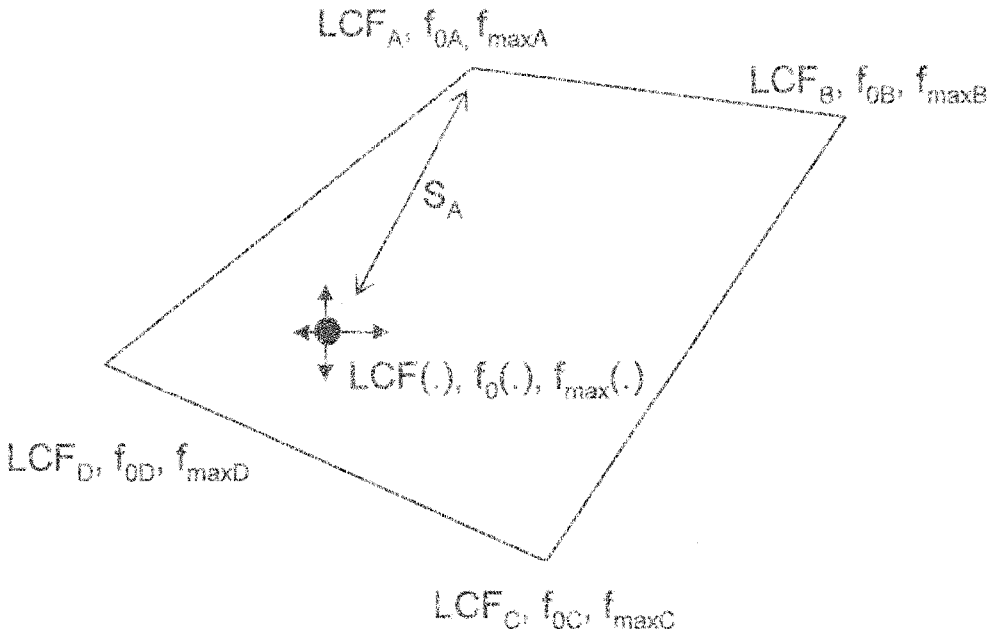
FIG. 5 shows a diagram illustrating a determination of frequency modification parameters by interpolation between values defined for typical sound environments.

FIG. 5 is a diagram illustrating a determination of frequency modification parameters by interpolation between "predefined frequency modification parameters". Such predefined parameters are provided for at least two typical sound environments; Typical sound environments can, for example, be A for "Calm Situations",
B for "Speech in Noise",
C for "Comfort in Noise" and
D for "Music".

The term "predefined" means in this context that the parameters are defined before the end-user actually uses the hearing aid device in real life. It is to be noted that for a particular frequency modification parameter, for example CF, there are generally only predefined frequency modification parameters for the at least two typical sound environments. Hence, for other sound environments the particular frequency modification parameter, for example CF, is not predefined and must be determined somehow during the dynamic frequency modification adjustment process as described further down below.

The determination of such predefined frequency modification parameters can, for example, be performed when fitting the hearing aid device, for example, during a visit at an audiologist's office. The hearing aid device is adjusted consecutively for each typical sound environment A, B, C and D. After each adjustment, before switching to the next environment, the found frequency modification parameters LCF, $f_0$ and/or $f_{max}$ are recorded, such that, in the end, there is a set of parameters for each typical environment. For example for environment A there is a logarithmic compression factor $LCF_A$, a lower spectral bound $f_{0A}$ and an upper spectral bound $f_{maxA}$. Instead of determining these sets of parameters manually by the audiologist it is also possible to determine them partially or fully automatically by the fitting software, for example, based on the measured hearing loss of the patient and/or based on other auditory test or interrogation results and based on statistical data about user preferences in general.

The following method can be applied for manually determining such predefined frequency modification parameters:

a) The end-user wears the hearing aid devices.
b) The hearing aid devices are connected to a fitting device which allows adjustment of current parameters LCF, $f_0$ and/or $f_{max}$ and programming of predefined parameters $LCF_A$, $f_{0A}$ and/or $f_{maxA}$, $LCF_B$, $f_{0B}$ and/or $f_{maxB}$ etc.
c) The end-user is exposed to a typical sound environment, in particular by playing recorded sound which corresponds to a typical sound environment, for example a recording of somebody talking for situation A or piece of classical music for situation D.
d) The fitter interrogates the user about his satisfaction with the current sound processing.
e) The fitter adjusts the logarithmic compression factor LCF, the lower spectral bound $f_0$ and/or the upper spectral bound $f_{max}$ for the typical sound environment until the end-user is satisfied with the adjustment. Hence, the parameters are now suitable for the typical situation.
f) The fitter programs the currently set parameters as predefined parameters, e.g. as $LCF_A$, $f_{0A}$ and $f_{maxA}$
g) Steps c) to f) are repeated for different typical sound environments until predefined parameters have been programmed for all typical sound environments (e.g. A, B, C and D).

During operation, i.e. use in real life, LCF, $f_0$ and/or $f_{max}$ are then adjusted automatically. First, a similarity of the current sound environment with at least one typical sound environment is determined. The result can, for example, be a similarity value $S_A$ or a similarity vector ($S_A$, $S_B$). The determination of similarity values is described in more detail in EP 1 858 292 A1. Then, new values for the dynamic, i.e. not static, parameters LCF(.), $f_0$(.) and/or $f_{max}$(.) are calculated by interpolating between the predefined parameters in accordance with the similarity value. The term "in accordance with" means that in case of a high similarity with a particular typical environment (e.g. 90%) the predefined parameters for this environment are weighted more (e.g. with weight 0.9 in a weighted averaging). The calculations are performed often enough to assure a reasonable fast response to changed conditions and so as to keep the interpolation steps small, for example by allowing at least about 100 interpolation steps for a transition from one typical environment to an other. There must be predefined parameters for at least two typical sound environments and at least one similarity value must be determined. However, preferably predefined parameters are programmed for three to four typical sound environments and a similarity value is determined for each of them. The solution has the advantage that individual preferences of the user, such as "frequency modification for speech, but not for speech in noise", can be accommodated in an efficient, user-friendly and precise way. Due to the interpolation disturbing switching artefacts are at least partially avoided.

It is to be noted that the predefined parameters for different environments, such as the parameters $LCF_A$, $f_{0A}$ and $f_{maxA}$ for environment A, can also be expressed as delta-values which indicate the difference to a standard or base environment.

Figure 6:
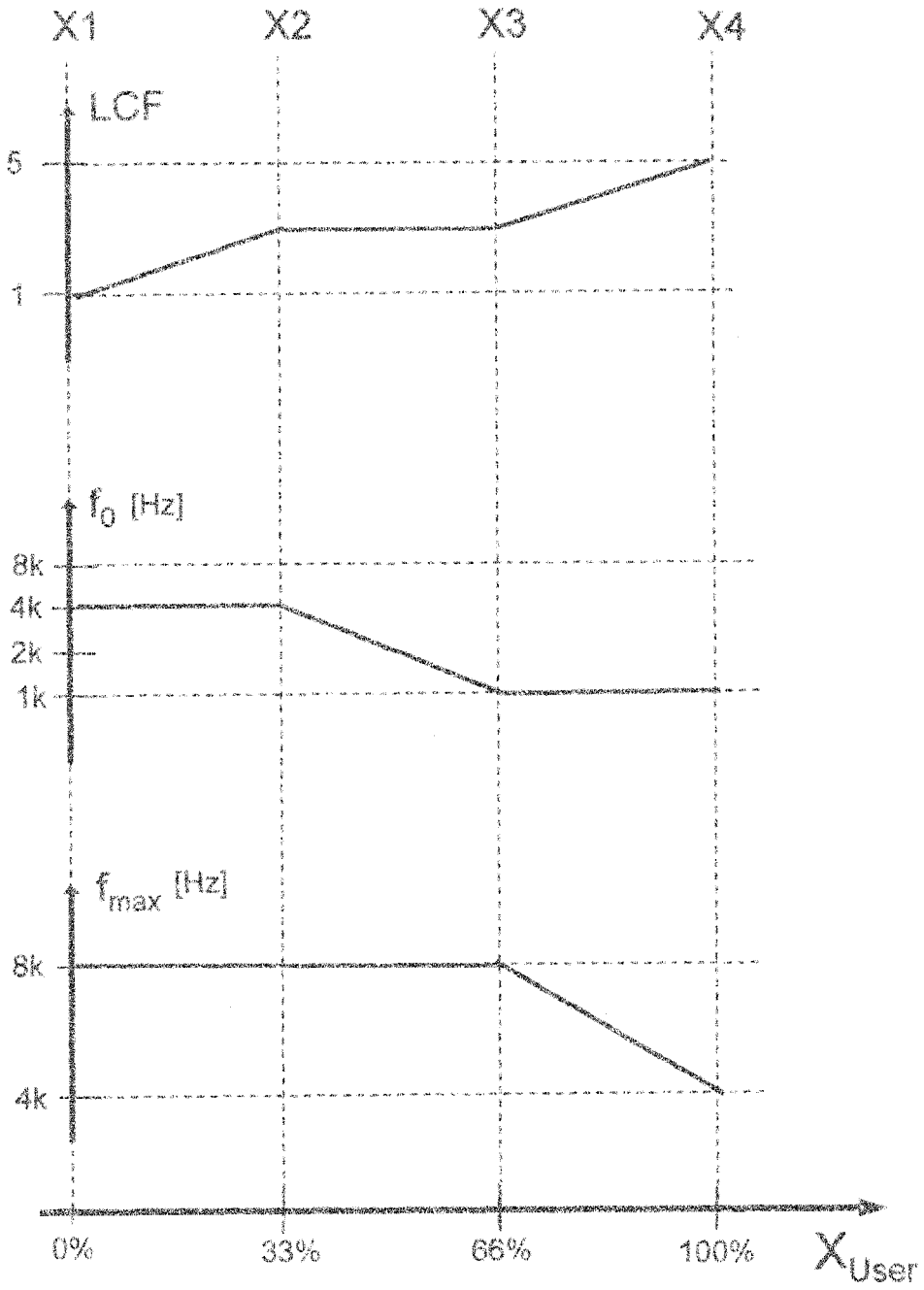
FIG. 6 shows a diagram illustrating how the frequency modification parameters compression factor, lower spectral bound and upper spectral bound can be adjusted in dependency of an end-user controllable parameter.

FIG. 6 shows how the frequency modification parameters logarithmic compression factor LCF, lower spectral bound $f_0$ and upper spectral bound $f_{max}$ can be adjusted in dependence on a single end-user controllable parameter $X_{User}$. The end-user controllable parameter can, for example, be changed with a potentiometer or with an up/down switch on the hearing aid device or with similar buttons or menu options on a remote control device. The conversion scheme for converting the end-user controlled parameter $X_{User}$ into frequency modification parameters can be predefined at the factory or during a fitting session, by programming predefined frequency modification parameters, e.g. $LCF_{X1}$, $LCF_{X2}$, $f_{0X1}$ and $f_{0X2}$ etc., which are predefined for particular states, e.g. X1, X2 etc., of the end-user controllable parameter $X_{User}$, in a similar manner as parameters may be predefined for particular sound environments as described referring to FIG. 5. When the end-user changes the end-user controllable parameter $X_{User}$ by actuating an end-user control the frequency modification is automatically adjusted in response to this change by calculating and activating updated frequency modification parameters, wherein said calculating comprises the step of interpolating between said predefined frequency modification parameters accordance with the current value of the end-user controllable parameter $X_{User}$, as shown in the figure, and/or the step using said predefined frequency modification parameters as a look-up table, wherein preferably number of predefined frequency modification parameters corresponds to the number of states the parameter $X_{User}$ can be in.

In the example shown in the figure $X_{User}$ has the states X1, X2, X3 and X4, or expressed as values 0%, 33%, 66% and 100%. In an other example $X_{User}$ may assume the values 0 to 10 or −10 to +10 with step size 1.

The end-user controllable parameter $X_{User}$ can be subject to logging and learning. Logging means that states and/or events of the hearing aid device and/or statistical information about such states and/or events are recorded. Learning means that the behaviour of the hearing aid device is adapted automatically to the preference of the user based on such states, events and/or recorded data. In particular changes of the parameter $X_{User}$ made by the end-user or statistical information about such changes can be stored in a non-volatile memory of the hearing aid device. During a fitting session this information can be used to manually or automatically readjust predefined parameters of the hearing aid device. In particular there can be a power-on value for the end-user controllable parameter $X_{User}$. Such a value is stored in the non-volatile memory of the hearing aid device and is programmed by the fitting device. However, it is also possible that this power-on value is subject to a "learning", i.e. that it is automatically readjusted by the hearing aid device based on current and previous settings of the end-user controllable parameter $X_{User}$.

It is to be noted that an end-user based adjustment, as described referring to FIG. 6, can be combined with an sound-environment based adjustment as described referring to FIG. 5. In this case, the predefined frequency modification parameters for particular states, e.g. X1, X2 of the end-user controllable parameter and/or the ones for typical sound environments, e.g. A, B, might preferably be defined, as already indicated above, as delta-values instead of absolute values.

Figure 7:
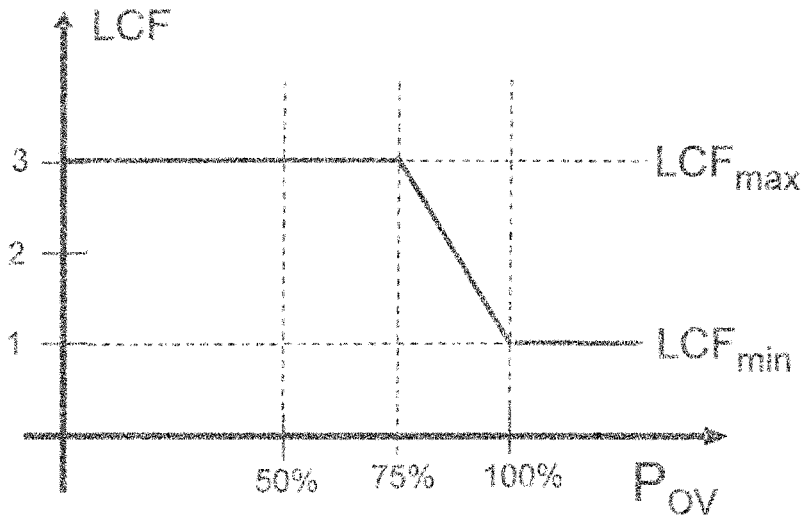
FIG. 7 shows a diagram illustrating, how frequency modification can be reduced in case of own-voice.
Figure 8:
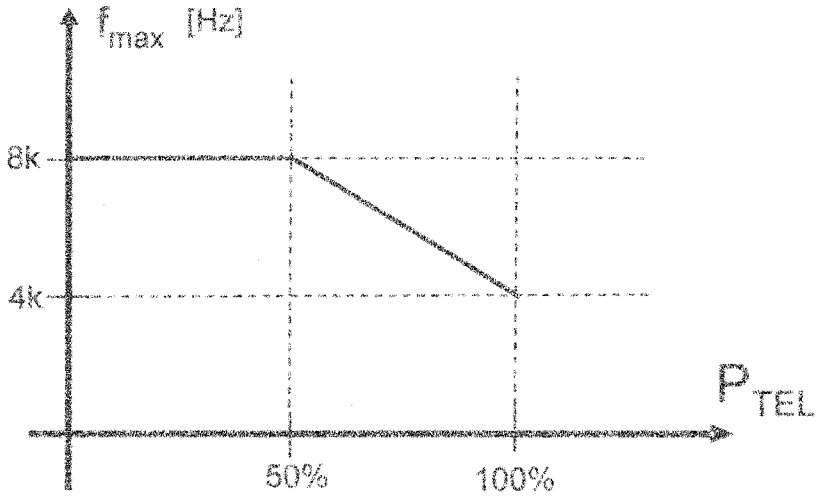
FIG. 8 shows a diagram illustrating how frequency modification can be reduced in case of telephone conversations.

It is further to be noted that even though the example of FIG. 6 shows the conversion of a single end-user controllable parameter $X_{User}$ into three frequency modification parameters, the same principle can be applied in any case where a frequency modification is to be controlled optimally in dependence on a single parameter, wherein one or more frequency modification parameters are derived from the single parameter. Since this single parameter represents in the determination of frequency modification parameters an intermediate result it is also referred to in the present document as "intermediate frequency modification parameter". Such an intermediate frequency modification parameter can be adjusted like any other of the frequency modification parameters such as for example a compression factor. In particular the following sound environment analysis results can be treated as intermediate parameters, i.e. that further frequency modification parameters can be derived from them by some sort of calculation:

a similarity value, as described referring to FIG. 5;

an own-voice indicator, as described referring to FIG. 7;

a telephone indicator, as described referring to FIG. 8.

In the examples of FIGS. 5 and 6 the lower spectral bound $f_0$ is adjusted. Such an adjustment changes the bandwidth of the part of the spectrum, to which frequency modification is applied, and therefore also the processor load necessary for the operation. In a particular embodiment, the predefined frequency modification parameters are defined such that a signal processor load caused by frequency modification is limited. The processor load depends on the bandwidth to which frequency modification is to be applied. Hence, by coupling $f_0$ and $f_{max}$ properly, the processor load can be controlled. Alternatively, the upper spectral bound $f_{max}$ can be set adaptively dependent on the processor resources available in a specific situation, in particular such that $f_{max}$ is maximized. In practice, an end-user could, for example, actuate a control to chose "more frequency modification". Together with lowering the lower spectral bound $f_0$ eventually also, the maximum input frequency $f_{max}$ would be lowered to avoid a processor overload. Even though such behaviour seems disadvantageous at first sight, it can e.g. be beneficial in telephone conversations as also indicated further down below referring to FIG. 8. The frequency modification bandwidth could also be reduced by raising $f_0$ and/or by lowering $f_{max}$ whenever other processing resources requiring features, such as noise cancellers, are activated.

It is to be noted that even though in the examples of FIGS. 5 and 6, primarily only the parameters LCF, $f_0$ and/or $f_{max}$ are mentioned, other frequency modification parameters, in particular any such parameters described in this document including also parameters of different frequency modification schemes, can be adjusted in the described manner.

FIG. 7 is a diagram illustrating, how frequency modification can be altered and in particular reduced or switched off in case of own-voice. Frequency modification can increase the so called occlusion effect by making sounds, in particular speech, emitted by the hearing aid device wearer him or herself especially audible. This kind of speech sound is referred to as "own-voice". One embodiment of the invention adjusts frequency modification in dependence on an own-voice detection. The environment sound analysis provides a probability value $P_{0V}$, for such an own-voice condition. Above a certain limit (here 75%), frequency modification is reduced and then (at 100%) fully switched off. The own-voice is thereby perceived less disturbing and the occlusion effect is reduced. In the frequency modification scheme as described referring to FIGS. 3 and 4 a reduction of frequency modification can be achieved by adjusting the logarithmic compression factor LCF and/or the lower frequency bound $f_0$. However, in other frequency modification schemes other frequency modification parameters might have to be adjusted for reducing or switching off the frequency modification.

Figure 9:
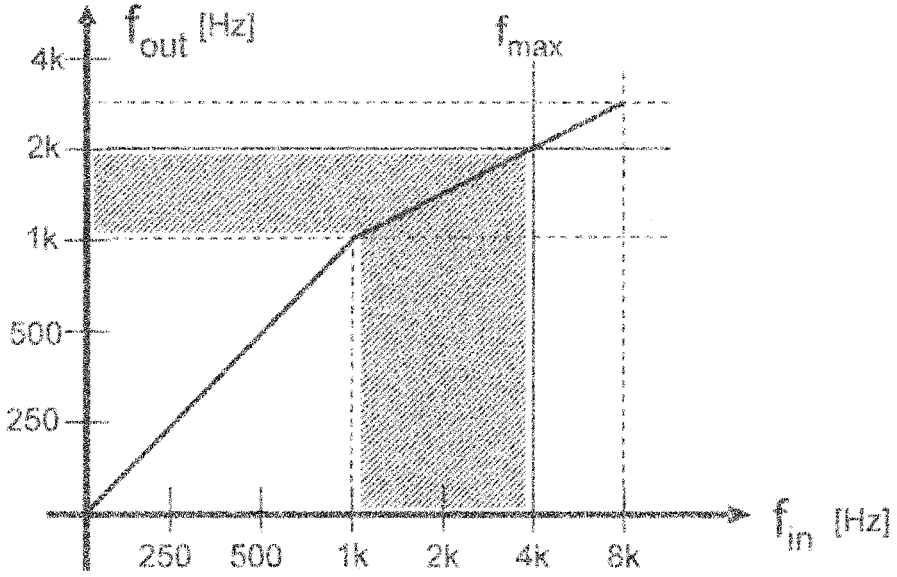
FIG. 9 shows a diagram illustrating how computational resources are saved by selecting a lower maximum input frequency.

FIG. 8 and FIG. 9 are diagrams illustrating how frequency modification can be adjusted and in particular be reduced in case of listening situations, in which the predominant listening target is a sound source with limited high frequencies, like, for example, in telephone conversations. The example is based on the frequency modification scheme introduced referring to FIGS. 3 and 4, but might also be applied to other schemes. It is to be noted that the predominant listening target is not necessarily the predominant signal in regard to the sound level or energy, but instead a signal from which it can be expected that the hearing aid device wearer wants to listen to, i.e. which is likely to be a "listening target". The sound environment analysis in this context might therefore well include evaluating non-acoustic indicators or factors such as sensing the presence of a magnet attached to a telephone handset held next to the hearing aid device, the manual selection of a specific hearing program by the end-user or the presence of an electric input signal provided by an other device such as a radio. It is further to be noted that a listening situation in this context will last at least one or more seconds and up to several minutes or even hours, such as for example given by the typical duration of telephone calls. As already indicated above, the term "limited high frequencies" is to be understood relative to the basic frequency range of the hearing aid device. Hence, the highest frequency emitted by such a "sound source with limited high frequencies" is significantly below the highest frequency which can be processed by the hearing aid device. The term "significantly below" can be defined as having a frequency which is at least 25% lower, as for example a frequency of less than 6 kHz in a 8 kHz hearing device. This highest frequency or upper band limit of the hearing aid device is usually determined by the sampling rate of its A/D converter. The highest frequency is half the sampling rate. Typically it is about 10 kHz. Sound transmission by telephone has usually an upper band limit which is lower than such an upper band limit of a standard hearing aid device. In cellular networks it may be lower than in landline networks. The example shown in the figure assumes such a limit at 4 kHz. However, other limits such as 3.5 kHz or 5.5 kHz might be appropriate. Reducing the extent of frequency modification by reducing the upper spectral bound $f_{max}$ of the part of the spectrum to which frequency modification is applied and above which no processing takes place in such conditions has two advantages: Firstly noise which might exist outside of the band transmitted by the telephone can be disturbing, both regarding the pleasantness as well as regarding the intelligibility of the speech signal. Secondly, reducing the bandwidth of the signal to which frequency modification is applied saves processing resources. These can be used for other features, such as a noise-cancelling, or, if they are not used for other purposes, e.g. battery resources can be saved. FIG. 9 illustrates how processing resources are saved in such a case. It shows an in a diagram the input/output frequency relation. In the shaded range frequency modification is applied. By lowering $f_{max}$ the range becomes smaller. Preferably $f_{max}$ is lowered to a value in the range from 3.5 to 6 kHz, in particular 5.5 kHz. Detection of telephone conversations can be performed in many ways as known in the state of the art and provides preferably a probability $P_{TEL}$ for the condition. FIG. 8 shows an example of how the upper spectral bound $f_{max}$ can be set in dependence on $P_{TEL}$. A possible implementation detects if there is a useful signal in the high frequencies above a particular limit frequency. The limit frequency can be chosen fixed, for example in the range from 3.5 to 6 kHz. However, it can also be the result of the detection, such that 10 kHz in a 10 kHz-device, i.e. a device which normally processes sounds up to 10 kHz, would mean "no telephone conversation". Preferably the upper spectral bound $f_{max}$ is set to this result. It is to be noted that this feature might not only be useful in telephone conversations, but in any case when sound is reproduced by a technical device with limited bandwidth, such as AM-radio, CB-radio, intercom or public address systems. Further, if the sound source is a technical device, it might feed the sound non-acoustically, in particular electrically and/or electromagnetically, to the hearing aid device. This is for example the case when an mp3-player is electrically connected to an audio streaming device worn by the end-user which then wirelessly transmits the audio signal to a hearing aid device.

Figure 10:
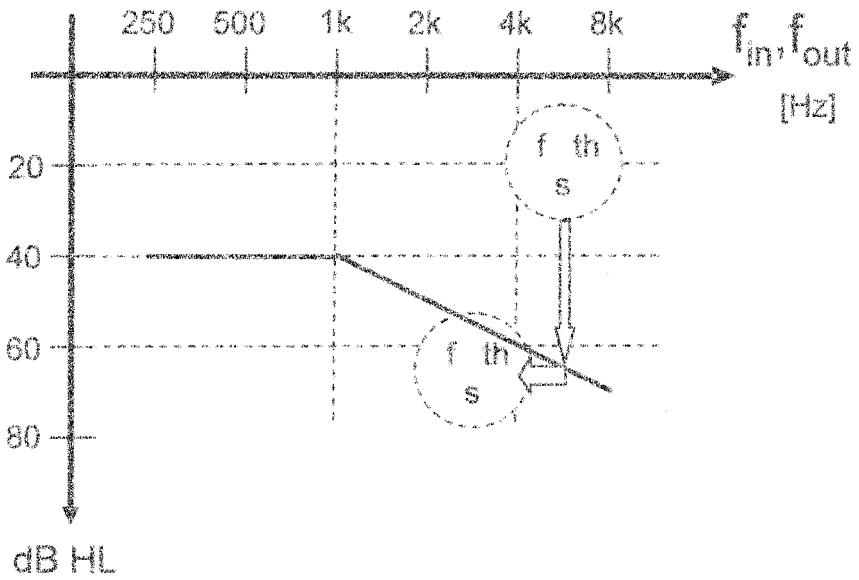
FIG. 10 shows a typical audiogram illustrating the effect of frequency modification on voiceless fricatives.

FIG. 10 shows an audiogram of a typical individual which can benefit from a frequency modification and in particular from the kind of frequency modification described referring to FIGS. 3 and 4. There is a mild to moderate hearing loss in the low frequencies and a relatively steep sloping hearing loss for higher frequencies. The curve indicates the hearing loss in decibel relative to a normal hearing individual. "dB HL" stands for "decibel hearing level". The figure also shows the characteristics of certain soft speech sounds or phonemes, namely the group of voiceless fricatives consisting of "f" which is a labiodental fricative, "th" which is a dental fricative, and "s" which is an alveolar fricative. "f", "th" and "s" are extremely weak sounds, with 20 dB HL just a little bit above the threshold of normal hearing. Their frequency range is between 5 and 6 kHz, which is at the edge of the bandwidth of a hearing aid device, especially if thin tubes or open fittings are applied. A simple amplification, which is always restricted by feedback and power limitations, would not be sufficient to make the voiceless fricatives "f", "th" and "s" audible. This is the case in many conventional hearing aid devices which are fitted without frequency modification. By applying a frequency modification in addition to applying some reasonable high frequency gain as indicated by the arrows, these phonemes become audible, which is the benefit at the cost of artefacts such as harmonic distortions. In addition there is the cost that noise in the upper frequency range, which would not be audible without frequency modification, becomes audible. Hence, as illustrated, frequency modification provides a significant benefit in situations where weak low level phonemes such as "f", "th", and "s" can be made audible. In other situations frequency modification is less likely to provide a benefit and can therefore be less active or be completely switched off. The particular situations "own-voice" and "telephone conversation" have already been discussed.

Figure 11:
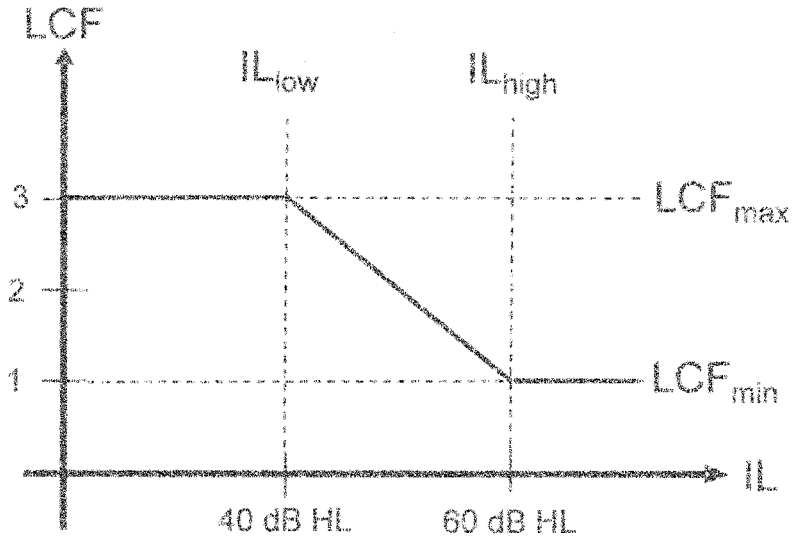
FIG. 11 shows a diagram illustrating how frequency modification may depend on the input level.

In the following, referring to FIG. 11, the situation "noisy environments" is discussed. The diagram illustrates how in one embodiment of the invention the extent of frequency modification is changed in dependence on the overall input level encountered by the device. The example is based on the kind of frequency modification described referring to FIGS. 3 and 4, but the principle can also be applied to other frequency modification schemes. There is no frequency modification below a lower spectral bound $f_0$ and the frequency modification above the lower spectral bound $f_0$ is varied dynamically, in particular by adjusting the logarithmic compression factor LCF. The sound environment analysis provides as a result a value indicative of an overall input level encountered by the hearing aid device. Typically this is an average over all frequencies, but for example for simplification also only certain selected frequencies might be regarded. For input levels above a threshold, in particular a threshold in a range from 30 to 60 dB or from 40 to 50 dB, frequency modification is reduced or switched off. In the shown example for input levels above an upper input level threshold $IL_{high}$ of 60 dB HL the frequency modification is switched off completely, because it is assumed that under such noisy conditions there are either no voiceless fricatives and if there were, they could not be made audible by a frequency modification. For input levels below a lower input level threshold $IL_{low}$ of 40 dB HL the extent of frequency modification is set to a maximum, in the example defined by a maximum logarithmic compression factor $LCF_{max}$ of 3. As already indicated $LCF_{max}$, $IL_{low}$, and/or $IL_{high}$ may be programmable by a fitting device. In the range from the lower threshold $IL_{low}$ to the upper threshold $IL_{high}$ the compression factor LCF is gradually decreased in a linear manner. The behaviour shown in the diagram can also be described by the following equation:

$$LCF = \begin{cases} LCF_{max} & \text{for } IL \le IL_{low} \\ LCF_{max} - \dfrac{(IL - IL_{low}) \times (LCF_{max} - 1)}{IL_{high} - IL_{low}} & \text{for } IL > IL_{low} \text{ and } IL < IL_{high} \\ 1 & \text{for } IL \ge IL_{high} \end{cases}$$

More generally speaking, the frequency modification is reduced for loud sound environments and increased for soft sound environments, or accordingly, the extent of frequency modification and the sound level are inversely dependent on each other. In one embodiment the lower input level threshold $IL_{low}$ is between 30 and 50 dB, in particular 40 dB, and the upper input level threshold $IL_{high}$ is between 50 and 70 dB, in particular 60 dB. In a particular embodiment both thresholds are the same, which results in the frequency modification being either completely "on" or completely "off", thus having two discrete states. Analyzing the sound environment by simply detecting its overall input level has the advantage that it can be implemented with far less complexity and that it is much more reliable than detecting speech or certain phonemes themselves. Compared to such solutions with complex analysis the risk that speech cues are lost due to a misinterpretation of the sound environment is significantly reduced. Unmasked, soft high frequency sounds are made audible independent of them being phonemes or not. The distraction of the user in the case that they are not desired speech cues is small because of the sounds being restricted to soft sounds.

Alternatively to analyzing the overall input level also the sound level in certain frequency bands can be used to adjust frequency modification. The same inverse dependency of input level and extent of frequency modification applies. For example the input level in the range of the voiceless fricatives or above a particular limit frequency, which is preferably in the range from 3 kHz to 5 kHz and is in particular about 4 kHz, can be regarded.

Figure 12:
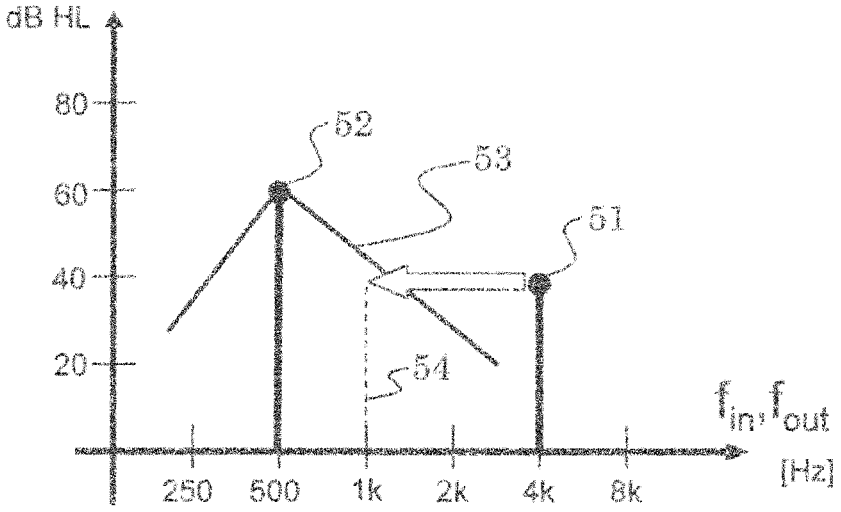
FIG. 12 shows a diagram illustrating how an excitation pattern of a low frequency sound may mask a frequency modification result.

FIG. 12 illustrates a further condition in which frequency modification is preferably reduced or switched off, namely a "masking by excitation patterns". The diagram shows how the excitation pattern of a low frequency 52 sound may mask the result 54 of a down-shifting of a high frequency sound 51 in the end-user's perception. When a pure tone is presented to a human ear the basilar membrane not only of this tone, but also of neighbouring tones are excited according to a so called "excitation pattern". The term is also mentioned in EP 0 836 363. In the case of hearing impaired individuals this pattern becomes even wider thereby masking more sound signals. If there is a sufficiently loud low frequency sound 52, signals shifted from high frequencies to lower frequencies might not be audible due to the masking by the excitation pattern 53 of said sound. It is to be noted that a masking by an excitation pattern can occur even when the masking signal and the masked signal have substantially different frequencies. Hence, masking by excitation patterns will typically also occur in frequency modification schemes, which do not apply superposition, which is, as defined above, a mapping of different frequencies to the same frequency.

In one embodiment of the invention the sound environment analysis is configured to provide an indication if such a masking by excitation patterns would be encountered if a particular frequency modification with particular frequency modification parameters is applied. If there is such an indication frequency modification is adjusted and is in particular switched off (or left switched off). On one hand this saves processing and battery resources, which would be otherwise employed without benefit. On the other hand it might still be possible to provide some audibility by a simple amplification instead of a frequency modification.

The following frequency modification adjustments are possible to counteract masking by excitation patterns:

- applying frequency modification only to frequency bands where no such masking occurs, for example by adjusting the lower spectral bound $f_0$ and/or the upper spectral bound $f_{max}$,
- reducing the shifting distance, for example by adjusting the logarithmic compression factor LCF,
- changing the amplification of modified frequencies relative to the amplification of frequencies which are not modified. A parameter defining such a relative amplification can be regarded as a further frequency modification parameter and can be termed "amplification parameter".

In particular the intensity of the masking sound, in the shown example the low frequency sound 52, can be reduced such that the result 54 of the frequency modification is no longer masked. Such a attenuation or suppression of low frequency signals can further be dependent on an analysis which determines if the masking sound 52 is noise or rather a useful signal.

It is also to be noted that such a masking by an excitation pattern may be encountered by any frequency modification which reduces the spectral distance between two sounds. Hence, it may, for example, result from down-shifting a low frequency sound less than a high frequency sound as well as from up-shifting a low-frequency sound more than a high frequency sound. The above described measures for avoiding the masking can be applied accordingly.

The terms "low frequency sound" and "high frequency sound" can be simply defined as the first sound being lower than the second sound. However, also a limit between low and high frequency sounds can be defined in this context, for example 1 kHz, $f_0$ or the middle of the processed input spectrum on a logarithmic scale.

In a particular embodiment, the shape of an excitation pattern used in the calculation, i.e. the detection of a potential masking, can be adapted to the hearing characteristic of the end-user.

Preferably, in any embodiment where frequency modification is automatically adjusted during operation, the adjustment in response to a changed sound environment is performed gradually over time even if the sound environment changes suddenly. In particular changing a frequency modification parameter from a minimum to a maximum or vice versa takes a certain smoothing time, in particular in the range from 0.5 to 10 seconds. It is preferably long enough that there are no audible transition artefacts. The overall transition may still be audible, in particular when comparing the before and after situation. A "transition artefact" in this context is a sound characteristic on top of the basic transition itself, for example when the start and/or the end of the transition period can be noticed. In a particular example the logarithmic compression factor LCF is adjusted in a frequency modification scheme of the kind described referring to FIGS. 3 and 4. Changing from a maximum compression factor $LCF_{max}=3$ to a minimum compression factor $LCF_{min}=1$ takes about 5 seconds. If adjustments are performed in an asymptotical manner the smoothing time can for example be defined to be the time until the parameter is within 10% of its target value.

In some of the above described embodiments frequency modification is in certain situations switched off completely. However, it can be advantageous to always maintain a slight residual frequency modification in order to maintain the benefit of frequency modification in regard to feedback reduction. Feedback is an especially disturbing artefact typically perceived as a whistling noise and is more likely to occur in the case of open fittings. For example the minimum compression factor LCF can be set to 1.1 instead of 1.0 or it can be set to 0.9 instead of 1.0 which would be a slight expansion. In cases where frequency modification parameters are programmed manually such a residual frequency modification component may be added automatically, in particular if an analysis of the overall system configuration indicates that feedback might be a problem.

Different ways of dynamically adjusting frequency modification parameters during use of a hearing aid device by an end-user have been described referring to FIGS. 3 to 12. It should be noted that these solutions, if not already explicitly mentioned, can be combined in various ways.

Figure 13:
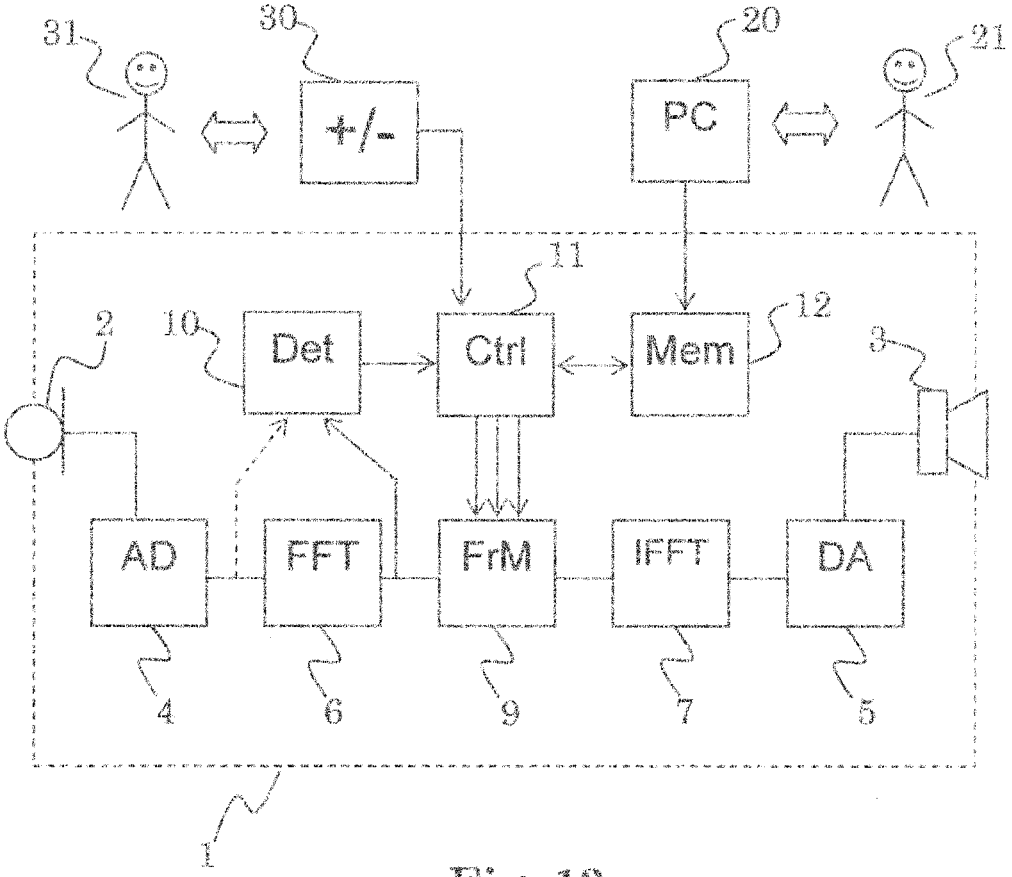
FIG. 13 shows a diagram of the functional blocks of a hearing aid device according to an embodiment of the invention.

FIG. 13 is a block diagram showing the functional blocks of a digital frequency modifying hearing aid system according to an embodiment of the invention. The system comprises a hearing aid device 1, a fitting device 20 and a remote control 30. At least one microphone 2 is exposed to a sound environment. The analogue microphone signal is converted to a digital signal using an analogue to digital converter 4.

The digital signal is transformed from the time to the frequency domain by a fast Fourier transform (FFT) using a fast Fourier transform means 6. A detection means 10 performs a sound environment analysis and may provide as an analysis result one or more of the following values:

- one or more similarity values, such as $S_A$, indicative of a similarity of the current sound environment with a particular typical sound environment, such as an environment A "calm situations",
- an analysis value $P_{OV}$ indicative of whether the end-users voice is present,
- an analysis value $P_{TEL}$ indicative of whether the end-user is in a listening situation in which a predominant listening target is a sound source with limited high frequencies such as a telephone,
- if such a sound source with limited high frequencies is detected, an estimation of the maximum frequency of the sound source,
- an analysis value indicative of whether a current sound environment is sufficiently noisy to mask normally loud spoken speech, in particular an overall input level encountered by the hearing aid device 1 or a value indicating if this level is above a certain threshold,
- an analysis value indicative of whether application of a particular frequency modification defined by particular frequency modification parameters would shift frequencies into an excitation pattern of other sounds, Frequency modification is applied in the frequency domain by a signal processing means 9. The frequency modification is steered by a control means 11. Control means 11 adjusts one or more frequency modification parameters. The adjustment is performed while the hearing aid device is being used by the end-user in real life. The frequency modification parameters may comprise, as already indicated, depending on the applied frequency modification scheme one or more of the following:

- said frequency delta $f_{shift}$,
- said linear compression factor CF,
- said logarithmic or perception based compression factor LCF, PCF,
- said lower spectral bound $f_0$,
- said upper spectral bound $f_{max}$,
- said mapping parameter,
- said amplification parameter and
- said intermediate parameter The control means 11 performs the adjustment in dependence

- on the above mentioned sound environment analysis result provided by detection means 10 and/or
- on the current setting of an end-user control, which can be part of the remote control 30.

The adjustment by control means 11 may further be based on static parameters stored in a non-volatile memory 12. These static parameters are programmed in the factory and/or during a fitting session using the fitting device 12 and remain usually unchanged during real life use of the hearing aid device. Said static parameters may comprise, as already indicated above, one or more of the following:

- Predefined frequency modification parameters for typical sound environments, such as $f_{shiftA}$, $CF_A$, $LCF_A$, $PCF_A$, $f_{0A}$ and/or $f_{maxA}$ for a sound environment A and $f_{shiftB}$, $CF_B$, $LCF_B$, $PCF_B$, $f_{0B}$ and/or $f_{maxB}$ for a sound environment B,
- Predefined frequency modification parameters for states of an end-user controllable parameter $X_{USR}$, such as $f_{shiftX1}$, $CF_{X1}$, $LCF_{X1}$, $PCF_{X1}$, $f_{0X1}$, and/or $f_{maxX1}$ for a state X1 and $f_{shiftX2}$, $CF_{X2}$, $LCF_{X2}$, $PCF_{X2}$, $f_{0X2}$ and/or $f_{maxX2}$ for a state X2,
- Boundary values for the frequency modification parameters, for example a maximum $LCF_{max}$ and minimum $LCF_{min}$ for the logarithmic compression factor LCF,
- frequency modification parameters which are static, i.e. which are not adjusted during real life use of the hearing aid device by the end-user, for example the upper spectral bound $f_{max}$ may be static in some embodiments of the frequency modification scheme described referring to FIGS. 3 and 4,
- a definition the detection of which sound environment conditions are supposed to influence frequency modification, in particular a selection from the group consisting of "similarity with typical sound environment", "own voice", "phone conversation", "noisy environment", "masking by excitation pattern".

The non-volatile memory 12 may further be used to store one or more of the following:

- An initial power-on value of the end-user controllable parameter $X_{USR}$,
- logging data about states and events of the hearing aid device operation,
- any data which is to be programmed in the factory or during fitting of the hearing aid device.

The fitting device 12 can for example be a PC with fitting software and a hearing aid device interface such as NOHAlink™. The detection means 10 has as input a signal carrying information about the sound environment. This can in particular be the output of the analogue digital convert 4 and/or the output of the fast Fourier transform means 6. The output of the signal processing means 9 is converted back into the time domain by an inverse fast Fourier transform (IFFT) using an inverse fast Fourier transform means 7 and converted back into an analogue signal by digital to analogue converter 5. The output signal is presented to the end-user of the hearing aid device by a receiver 3. The hearing aid device 1 can for example be a behind the ear device (BTE), an in the ear device (ITE) or a completely in the ear canal device (CIC).

The described solutions with adjustment of frequency modification during real-life operation are in particular suited for so-called "open-fittings". In this case the receiver is generally coupled to the ear by a thin tube. There is only a small ear-piece or ear-tip, for example a so called "dome" tip or an ear-mould with a relatively large vent-opening. An open fitting has the advantage that there is less occlusion effect. This advantage is especially important in the case of mild or moderate hearing losses because such individuals are especially sensitive to it. Sounds from the user's body, in particular voice, are perceived softer since they can by-pass the ear-piece and exit the ear canal. Environment sounds can by-pass the ear-piece as well, as so-called "direct sound". Switching frequency modification partially and/or temporarily off not only reduces distortions of harmonic relationships within the processed signal, but also artefacts caused by a disharmonious combination of direct sound and processed sound.

The described solutions provide a good trade-off between sound naturalness and speech intelligibility. The method and device according to the invention can in particular be used for speech enhancement for sloping high frequency hearing losses. This kind of hearing loss is currently in the hearing aid industry the largest customer segment. The invention has therefore a high economic value.

LIST OF REFERENCE SYMBOLS

1 hearing aid device
2 microphone
3 receiver
4 analogue to digital converter
5 digital to analogue converter
6 fast Fourier transform means
7 inverse fast Fourier transform means
9 signal processing means
10 sound environment detection means
11 frequency modification control means
12 memory means
20 fitting device
21 audiologist
30 remote control
31 end-user of the hearing aid device
51 first signal component
52 second signal component
53 excitation pattern
54 result of down-shifting
101, 201 curve representing a linear shift
102, 202 curve representing no frequency modification
103, 203 curve representing a linear modification
104, 204 curve representing a logarithmic modification
$f_{in}$ input frequency
$f_{out}$ output frequency
$f_{map}$ frequency mapping function
$f_0$ lower spectral bound
$f_{max}$ upper spectral bound
CF linear compression factor
LCF logarithmic compression factor
PCF perception based compression factor
$LCF_{max}$ maximum compression factor
A, B, C, D typical sound environments
$LCF_A$ LCF for sound environment A
$f_{0A}$ $f_0$ for sound environment A
$f_{maxA}$ $f_{max}$ for sound environment A
$X_{USR}$ end-user controllable parameter
X1, X2, X3 states of the end-user controllable parameter
$LCF_{X1}$ LCF for state X1
$f_{0X1}$ $f_0$ for state X1
$f_{maxX1}$ $f_{max}$ for state X1
$P_{TEL}$ probability of telephone conversation
$P_{OV}$ probability of own voice
$IL_{low}$ lower input level threshold
$IL_{high}$ upper input level threshold

What is claimed is:

1. A method for adapting sounds in a hearing aid device to the needs of an end-user of said hearing aid device by frequency modification, said frequency modification being defined by one or more frequency modification parameters being defined as follows: a frequency delta by which an entire or a partial spectrum is shifted, a linear compression factor, according to which a linear frequency modification is applied to an entire or partial spectrum, a logarithmic or perception based compression factor, according to which a logarithmic or perception based frequency modification is applied to an entire or partial spectrum, a lower spectral bound of a frequency range to which frequency modification is applied, an upper spectral bound of a frequency range to which frequency modification is applied, a number of frequency ranges to which frequency modification is applied, a mapping parameter being part of a frequency mapping function, which maps input frequencies to output frequencies, an amplification parameter indicative of an amplification of modified frequencies relative to an amplification of unmodified frequencies, an intermediate parameter, from which at least one of frequency delta, linear compression factor, logarithmic or perception based compression factor, lower spectral bound, upper spectral bound, number of frequency ranges, mapping parameter, amplification parameter are derived, the method comprising the steps of: adjusting said frequency modification in dependence on a result of a sound environment analysis and/or in dependence on an end-user input by adjusting at least one of said one or more frequency modification parameters characterized by further comprising the steps of: providing predefined frequency modification parameters for at least a first and a second typical sound environment (A, B) and/or for at least a first and a second state of an end-user controllable parameter, and automatically adjusting at least one of said one or more frequency modification parameters based on said predefined frequency modification parameters whenever said sound environment analysis indicates a change of a currently encountered sound environment and/or whenever a change of said end-user controllable parameter occurs.

2. The method according to claim 1, wherein said predefined frequency modification parameters are determined during a fitting session based on an audiogram of said end-user and/or based on interrogating said end-user (31) and that said predefined frequency modification parameters are written to a non-volatile memory of said hearing aid device using a fitting device.

3. The method according to claim 2, wherein said predefined frequency modification parameters are defined such that a signal processor load caused by said frequency modification is limited.

4. The method according to claim 1 , wherein said sound environment analysis provides at least a first similarity value indicative of a similarity of a current sound environment with said first typical sound environment, wherein at least one of said one or more frequency modification parameters is determined by a calculation comprising the step of interpolating between at least two of said predefined frequency modification parameters of said at least first and second typical sound environment in accordance with said first similarity value.

5. The method according to claim 1, wherein actuation of an end-user control causes a change of said end-user controllable parameter, wherein at least one of said one or more frequency modification parameters is determined by a calculation, said calculation comprising the step of interpolating between said predefined frequency modification parameters for said first and second state of said end-user controllable parameter in accordance with said end-user controllable parameter, and/or the step of using said predefined frequency modification parameters as a look-up table in accordance with said end-user controllable parameter.

6. The method according to claim 5, wherein logging data for inspection during a fitting session incorporating a fitting device is derived from said end-user controllable parameter and is stored in a non-volatile memory of said hearing aid device, and/or an updated user preference based power-on value for said end-user controllable parameter is determined from current and previous settings of said end-user controllable parameter and is stored in said non-volatile memory.

7. The method according to claim 1, wherein said sound environment analysis provides an analysis value indicative of whether said end-user's own-voice is present, wherein at least one of said one or more frequency modification parameters is adjusted in dependence on said analysis value whenever said analysis value indicates that said end-user's own-voice is present.

8. The method according to claim 1, wherein said sound environment analysis provides an analysis value indicative of whether said end-user is in a listening situation, in which a predominant listening target is a sound source with limited high frequencies, wherein at least one of said one or more frequency modification parameters is adjusted in dependence on said analysis value whenever said analysis value indicates said listening situation.

9. The method according to claim 8, wherein, whenever said listening situation is likely, said upper spectral bound is reduced, to a value in a range from 3.5 to 6 kHz, or to an estimate of an upper frequency limit of said sound source provided by said sound environment analysis.

10. The method according to claim 1, wherein said sound environment analysis provides an analysis value indicative of whether a current sound environment is sufficiently noisy to mask normally loud spoken speech or to mask certain normally loud spoken phonemes, wherein at least one of said one or more frequency modification parameters is adjusted in dependence on said analysis value whenever an overall input level of said hearing device is above a threshold.

11. The method according to claim 10, wherein at least one of said one or more frequency modification parameters is set to a first marginal value if said overall input level is above an upper threshold, and is set to a second marginal value if said overall input level is below a lower threshold.

12. The method according to claim 10, wherein said certain normally loud spoken phonemes are high frequency phonemes or phonemes above 4 kHz.

13. The method according to claim 1, wherein said sound environment analysis is configured to provide an indication of whether applying a particular frequency modification would result in a condition where a first signal component is shifted into an excitation pattern of a second signal component, wherein, whenever there is said indication, said condition is avoided by: adjusting at least one of said one or more frequency modification parameters and/or attenuating said second signal component.

14. The method according to claim 13, wherein said first signal component is a high frequency sound and said second signal component is a low frequency sound and said particular frequency modification is a down-shifting.

15. The method according to claim 1, wherein said frequency modification is defined by the following three frequency modification parameters: said lower spectral bound, said logarithmic or perception based compression factor and said upper spectral bound, wherein frequencies below said lower spectral bound remain substantially unchanged and frequencies between said lower spectral bound and said upper spectral bound are progressively down-shifted without superposition in accordance with said logarithmic or perception based compression factor and wherein above said upper spectral bound substantially no processing takes place.

16. The method according to claim 15, wherein said lower spectral bound and said logarithmic or perception based compression factor are adjusted in dependence on said result of a sound environment analysis and/or in dependence on said end-user input and wherein said upper spectral bound, is left substantially unchanged.

17. The method according to claim 15, wherein said frequency modification is further defined by at least one of the following conditions: said lower spectral bound is in a range from 1 kHz to 10 kHz, said logarithmic or perception based compression factor is in a range from 1 to 5, said upper spectral bound is in a range from 3.5 to 10 kHz.

18. The method according to claim 1, wherein said frequency modification is performed digitally, in a frequency domain, wherein a time domain input signal is transformed into said frequency domain using an FFT operation, and a processed frequency domain signal is transformed into a time domain using an IFFT operation.

19. The method according to claim 1, wherein an adjustment of at least one of said one or more frequency modification parameters is performed gradually over time.

20. The method according to claim 10, wherein the threshold is in a range from 30 to 60 dB.

21. The method according to claim 11, wherein said lower threshold is between 30 and 50 dB and said upper threshold is between 50 and 70 dB.

22. The method according to claim 12, wherein said phonemes are voiceless fricatives or phonemes in the range between 5 and 6 kHz.

23. The method according to claim 1, wherein: the frequency delta is quantified as number of Hertz, the linear compression factor is quantified as a ratio of an input frequency to an output frequency or as a number of octaves or other musical intervals, and the logarithmic or perception based compression factor, is quantified as a ratio of an input bandwidth to an output bandwidth, wherein both bandwidths are measured on a logarithmic scale and/or are expressed as a number of octaves or other musical intervals.

24. The method according to claim 3, wherein the signal processor load is limited by adjusting said lower spectral bound and said upper spectral bound in such a way that a bandwidth, to which said frequency modification is applied, is limited.

25. The method according to claim 7, wherein said frequency modification parameter adjustment is such that said frequency modification is reduced or deactivated.

26. The method according to claim 8, wherein said frequency modification parameter adjustment is such that said frequency modification is reduced or deactivated.

27. The method according to claim 10, wherein said frequency modification parameter adjustment is such that said frequency modification is reduced or deactivated.

28. The method according to claim 13, wherein the adjustment of at least one of said frequency modification parameters is such that said frequency modification is reduced or deactivated.

29. The method according to claim 19, wherein changing from a minimum defined for a particular parameter to a maximum defined for said particular parameter takes 0.5 to 10 seconds and/or such that there are no audible transition artifacts.

30. The method according to claim 8, wherein said sound source is a technical device or a telephone.

31. The method according to claim 9, wherein said range in which said value to which said upper spectral bound is reduced is from 3.5 kHz to 5.5 kHz.

32. The method according to claim 9, wherein above said upper spectral bound no processing takes place.

33. A method for adapting sounds in a hearing aid device to the needs of an end-user of said hearing aid device by frequency modification, said frequency modification being defined by one or more frequency modification parameters being defined as follows: a frequency delta (fshift) by which an entire or a partial spectrum is shifted, a linear compression factor, according to which a linear frequency modification is applied to an entire or partial spectrum, a logarithmic or perception based compression factor, according to which a logarithmic or perception based frequency modification is applied to an entire or partial spectrum, a lower spectral bound of a frequency range to which frequency modification is applied, an upper spectral bound of a frequency range to which frequency modification is applied, a number of frequency ranges to which frequency modification is applied, a mapping parameter being part of a frequency mapping function, which maps input frequencies to output frequencies, an amplification parameter indicative of an amplification of modified frequencies relative to an amplification of unmodified frequencies, an intermediate parameter, from which at least one of frequency delta, linear compression factor, logarithmic or perception based compression factor, lower spectral bound, upper spectral bound, number of frequency ranges, mapping parameter, amplification parameter are derived, the method comprising the steps of: adjusting said frequency modification in dependence on a result of a sound environment analysis and/or in dependence on an end-user input by adjusting at least one of said one or more frequency modification parameters characterized by further comprising the steps of: providing predefined frequency modification parameters for at least a first and a second typical sound environment and/or for at least a first and a second state of an end user controllable parameter and automatically adjusting at least one of said one or more frequency modification parameters based on said predefined frequency modification parameters whenever said sound environment analysis indicates a change of a currently encountered sound environment and/or whenever a change of said end user controllable parameter occurs, wherein said sound environment analysis provides an analysis value indicative of whether a current sound environment is sufficiently noisy to mask normally loud spoken speech or to mask certain normally loud spoken phonemes, wherein at least one of said one or more frequency modification parameters is adjusted in dependence on said analysis value whenever an overall input level of said hearing device is above a threshold.

34. The method according to claim 33, wherein the threshold is in a range from 30 to 60 dB.

35. The method according to claim 33, wherein said frequency modification parameter adjustment is such that said frequency modification is reduced or deactivated.

* * * * *